US005604960A

United States Patent [19]

Good

[11] Patent Number: 5,604,960

[45] Date of Patent: Feb. 25, 1997

[54] MAGNETIC GARMENT CLOSURE SYSTEM AND METHOD FOR PRODUCING SAME

[76] Inventor: Elaine M. Good, 77 Bleeker St., Suite 903 N, New York, N.Y. 10012-1551

[21] Appl. No.: 444,855

[22] Filed: May 19, 1995

[51] Int. Cl.[6] ..... A44B 17/00; H01F 7/00

[52] U.S. Cl. ..... 24/303; 24/66.1

[58] Field of Search ..... 24/303, 66.1; 248/206.5, 248/309.4; 292/251.5

[56] References Cited

U.S. PATENT DOCUMENTS

| | | | |
|---|---|---|---|
| 2,319,292 | 5/1943 | Boggs | 292/251.5 |
| 2,363,914 | 11/1944 | Wakefield | 24/303 |
| 2,599,421 | 6/1952 | Wilm | 24/303 |
| 3,144,274 | 8/1964 | Harris | 24/303 |
| 3,161,932 | 12/1964 | Russell | 24/303 |
| 3,254,440 | 6/1966 | Duggar | 24/303 |
| 3,365,684 | 1/1968 | Stemke et al. | 24/303 |
| 3,827,020 | 7/1974 | Okamoto | 248/309.4 |
| 4,399,595 | 8/1983 | Yoon et al. | 24/303 |

*Primary Examiner*—Victor N. Sakran
*Attorney, Agent, or Firm*—Lorusso & Loud

[57] ABSTRACT

A closure system for a garment of any type, also useful to join two garments, including cooperating magnet assemblies, interdimensionally fixed to opposing closure surfaces of the garment, that securely and removably join the closure surfaces by the attractive action of the magnets. The magnet assemblies are laminates, each laminate produced from a support layer to which is added an adhesive layer. One or more magnets are positioned on the adhesive layer to align and retain them in place. Finally, a cover layer is added over the one or more magnets, and shaped to the magnet(s) to form the laminate that is the magnet assembly. A garment is securely joined when a magnet assembly is aligned with a cooperating magnet assembly, that is, one magnetically opposable, and the magnets attract each other. A garment is opened when the magnet assemblies on the opposing closure surfaces are disengaged from each other by peelably disengaging them.

18 Claims, 2 Drawing Sheets

MAGNETIC GARMENT CLOSURE SYSTEM AND METHOD FOR PRODUCING SAME

BACKGROUND OF THE INVENTION

The instant invention relates to clothing, and more particularly to a closure system for garments of all types, for men, women, children and even pets. The system of the present invention can also be used to attach two garments to each other, such as to put a scarf on a coat, or to add a tie to a shirt.

Conventional clothing is closed or fastened for wear in a number of ways. Buttons, zippers, hooks and eyes are the traditional means in which indoor wear and outdoor clothing are fastened.

These so-called conventional means of garment closure may be unacceptable for a wide range of people. One in five people in the world, both adults and children, are permanently physically disabled. Millions more people are temporarily disabled due to accident or illness. People who suffer from arthritis and Parkinson's disease, for example, and others with limited range of motion are also disabled in some manner. Blind people, as well, may experience difficulty in physical manipulations. For these people described above, conventional closure systems are at best challenging and at worst impossible to maneuver. Accordingly, the garment wearer is forced to rely on another person to assist them in dressing, leaving them unable to live independently.

Additionally, as very young children grow, they strive to become self sufficient and independent. Being able to dress oneself without a parent's help remains a milestone to be achieved.

In an effort to address the above needs, clothing manufacturers have tried different ways to fasten clothing. A popular choice is the use of Velcro closures. Velcro is a trademark of Velcro Industries, B.V. of Amsterdam, the Netherlands to describe a popular brand of hook and loop type fastening means. In Velcro closure systems, the separate hook and loop portions of the Velcro fastener are placed as desired on either of the two elements of the garment that are being fastened together.

Velcro closure systems have proven to be unacceptable for the needs of the persons described above. The two elements of the Velcro system have to be precisely aligned. If they are not, the system may not stay closed. Furthermore, even if the Velcro system keeps the elements of clothing fastened, the misaligned portions may touch the skin, and because of its makeup, rub the affected skin raw. Furthermore, Velcro does not hold up well to washing and drying, as its components buckle in the wash and pick up lint and thread in the dryer, all affecting the ability of the Velcro closure system to operate over the life of the garment.

Above all, a garment produced for any of the above-described people should be fashionable and well made, as well as extremely comfortable and easy to manage. Clothing incorporating an alternative closure system should be suitable for a variety of lifestyle choices, such as active wear, professional wear, and evening wear. In addition, hospitals, nursing homes and even home care providers will benefit from an alternative closure system for johnnies and other garments used for their patients.

Accordingly, it is an object of the present invention to provide a system for garment closure that can be easily operated by those physically challenged.

It is another object of the present invention to provide a system for garment closure that can be included in a variety of clothing, such as professional wear, active wear and evening wear.

Another object of the present invention is to provide a system for garment closure that can withstand repeated cleaning and still operate without problem to fasten the garment for the lifetime of the garment.

An additional object of the present invention is to provide a system by which two garments can be attached to one another.

Yet another object of the present invention is to provide clothing having a garment closure system that can be operated by those physically challenged in any manner.

A further object of the present invention is to provide a closure system, for a garment, that does not compromise the appearance of the garment and that can be incorporated into a variety of clothing and fashion accessories.

SUMMARY OF THE INVENTION

The present invention is a closure system for a garment of any type. The closure system includes cooperating magnet assemblies, interdimensionally fixed to opposing closure surfaces of a garment, that securely and removably join by the attractive action of the magnets. The magnet assemblies are laminates, each laminate produced from a support layer to which is added an adhesive layer. A series of magnets are positioned on the adhesive layer to align and retain them in place. Finally, a cover layer is added over the magnets, and shapes to the magnet to form the laminate that is the magnet assembly. A garment is securely joined when a magnet assembly is aligned with a cooperating magnet assembly, that is one magnetically opposable, and the magnets attract each other. A garment is opened when the magnet assemblies on the opposing closure surfaces are disengaged from each other by peelably disengaging them.

This invention will be described in connection to a shirt. It is equally well applicable, however, to clothing for men, women, and children, for example, dresses, blouses, pants or slacks, skirts, scarves, sweaters, coats, footwear, gloves and virtually any other garment worn by man or animal having opposing closure surfaces which are desired to be opened and closed. It is also applicable to attaching one garment to another, for example, when one desires to attach a scarf to a coat, or a tie to a shirt.

The invention itself, both as to its construction and method of operation, together with additional objects and advantages thereof, will be best understood from the following detailed description of the invention, taken together with the drawing.

DETAILED DESCRIPTION OF THE PREFERRED EMBODIMENTS

A significant aspect of the present invention is the closure system for closing overlapping portions of a garment in an easy and reliable manner. As used herein, the term "garment" shall mean any piece of clothing or fashion accessory, such as, for example, slacks, pants, shirts, blouses, scarfs and the like, and even an article made of a cloth or fabric. Virtually any garment can incorporate the closure system of the present invention. Additionally, the system can be used to attach one garment to another, for example to attach a scarf to a coat or a tie to a shirt. For the purposes of the present description, the term "closure system" is hereinafter intended to describe the application whereby a single garment is fastened and that in which one garment is secured to another.

Figure 1:
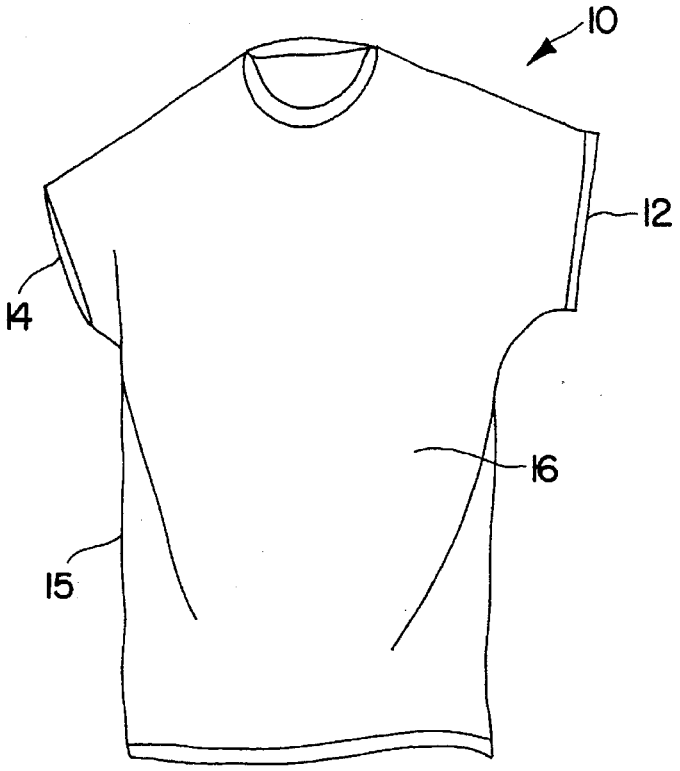
FIG. 1 is a perspective view of a woman's blouse having the closure system of the present invention.

For purposes of illustration and description, but not for purpose of limitation, the invention will be described in connection with a closure system on a side seam 15 underneath one sleeve 14 of the blouse 10 shown in FIG. 1. The closure system could, for example, be placed in a neck seam or in a back seam. The placement of the closure system of the present invention will be dependant only on the fashion dictates of the garment, and the ease of the wearer for putting on the garment. Referring to FIG. 1, reference number 10 generally identifies a garment, particularly a woman's blouse having a pair of sleeves 12, 14, a front panel 16, and a back panel 18 (shown in FIG. 2). It will be obvious from a thorough reading of the specification that a garment incorporating the closure system of the present invention may have any type of ornamentation or fashion. For example, the blouse 10 may have long sleeves and cuffs on the sleeves 12, 14, pockets, a neck band or any type of collar, and even a plurality of buttons down the front panel 16. In all respects, the garment will not appear markedly different from garments of the same type that are supplied everywhere.

Figure 2:
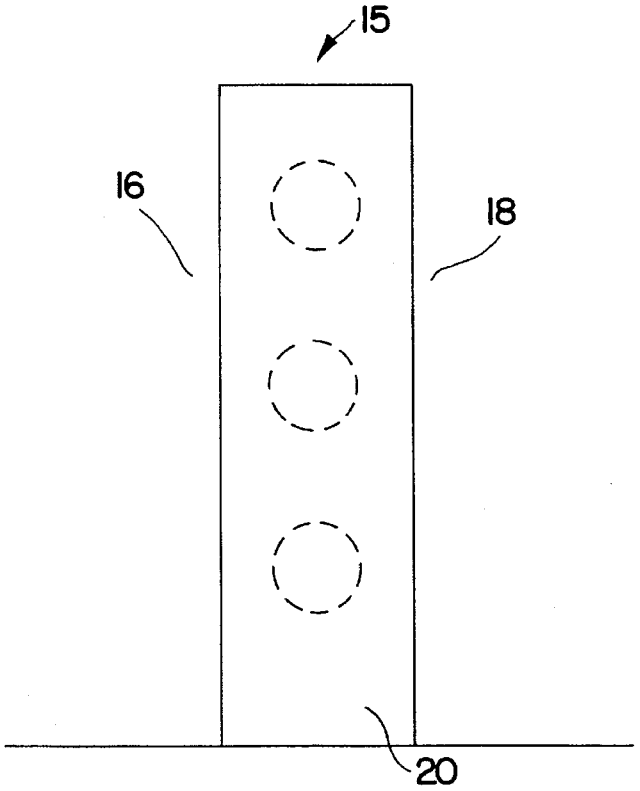
FIG. 2 is a perspective view of the securely joined closure system of the present invention incorporated into the blouse shown in FIG. 1 with the relevant sections of the blouse shown for reference and the magnets shown in phantom for the purposes of illustrating placement.

FIG. 2 illustrates a portion of the side seam 15 of blouse 10 incorporating the closure system 20 of the present invention, When the closure system 20 is fastened, it will not be obvious to the casual observer that a garment includes the closure system of the present invention.

Figure 3:
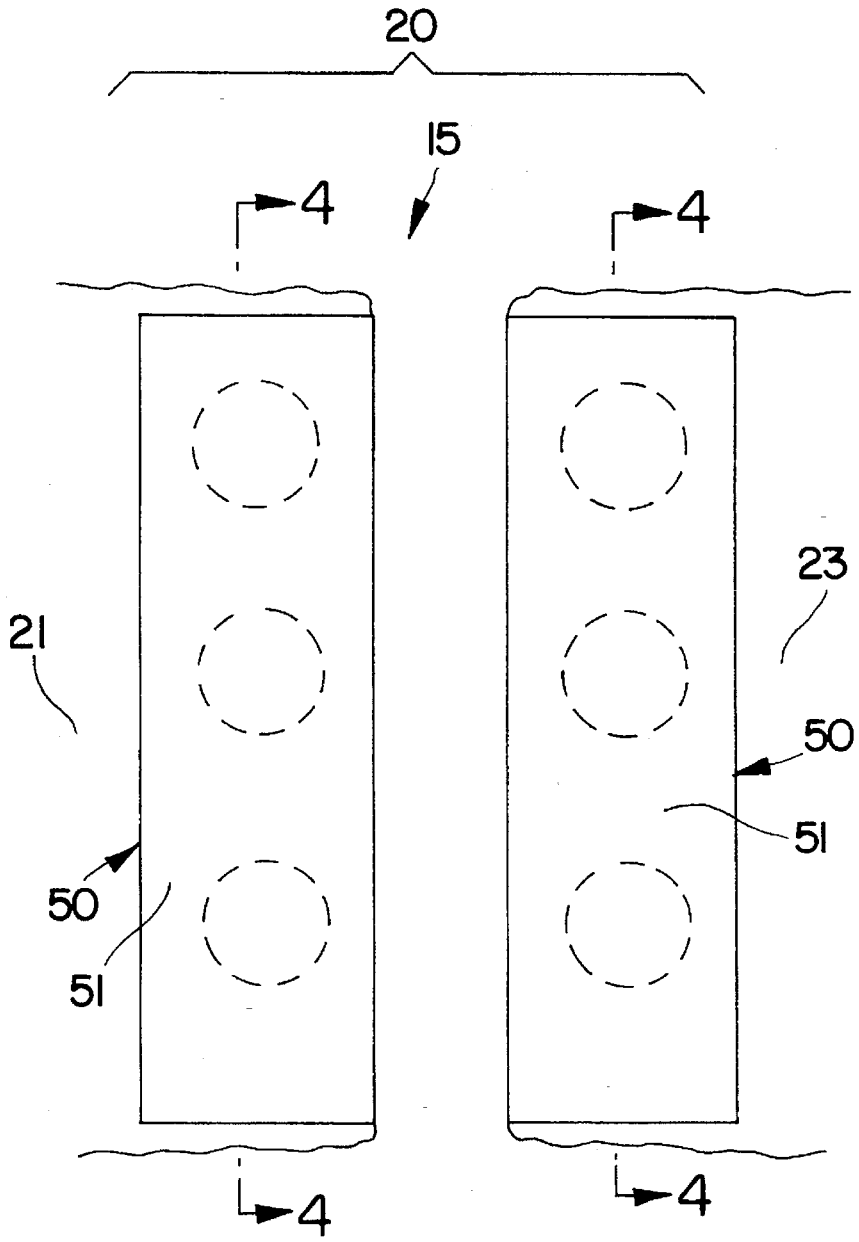
FIG. 3 is a view of the closure system of the present invention shown in FIGS. 1 and 2 when opened, with the magnets in the magnet assemblies shown in phantom.

As shown in FIG. 3, representative seam 15 has first and second opposing closure surfaces 21 and 23. First opposing closure surface 21 from the front panel 16 of the blouse 10 overlaps and opposes second opposing closure surface 23 from the back panel 18 of the blouse 10. Generally, the opposing closure surfaces 21 and 23 occur in a garment, in this case a blouse, when the fabric used to make the relevant panel is folded back at an end portion, such as to make a seam. Of course, it will be obvious to those skilled in the relevant art that there are other ways to prepare opposing closure surfaces to incorporate the closure system of the present invention. A magnet assembly 50 is attached to each of the opposing closure surfaces 21, 23, as described below.

The closure system 20 of the present invention is made up of two cooperating magnet assemblies 50. For the magnet assemblies 50 to be cooperating, each magnet assembly 50 has at least one magnet 53, the number of magnets 53 being equal in each magnet assembly 50 of a closure system 20 and each magnet 53 in one magnet assembly 50 joins with the cooperating magnet 53 of the at least one magnet 53 in the cooperating magnet assembly 50. In one embodiment, the at least one magnet 53 in one magnet assembly 50 cooperates with a "magnet" that is a metal disc on the other magnet assembly 50. In another embodiment, the at least one magnet 53 cooperates with at least one magnet 53 having a polarity opposite to the polarity of the at least one magnet 53 in the first magnet assembly 50. In a preferred embodiment, one magnet assembly 50 in the closure system 20 contains at least one magnet 53 having a polarity opposite in charge to the at least one magnet 53 in the other magnet assembly 50 of the closure system 20 and the at least one magnet 53 of both magnet assemblies 50 is of approximately the same magnetic field strength.

In a closure system with magnet assemblies 50 having only one magnet 53 each, the magnet 53 in one assembly has an opposite polarity and, in a preferred embodiment, approximately the same magnetic field strength, as the magnet 53 in the other magnet assembly 50 and therefore is deemed magnetically opposable for purposes of the instant description. In those closure systems 20 having more than one magnet 53 in each magnet assembly 50, magnetically opposable refers to a situation in which each magnet 53 in the one magnet assembly 50 is paired with a magnet 53 in the cooperating magnet assembly 50 of opposite polarity and, in the preferred embodiment, approximately the same magnetic field strength.

Figure 4:
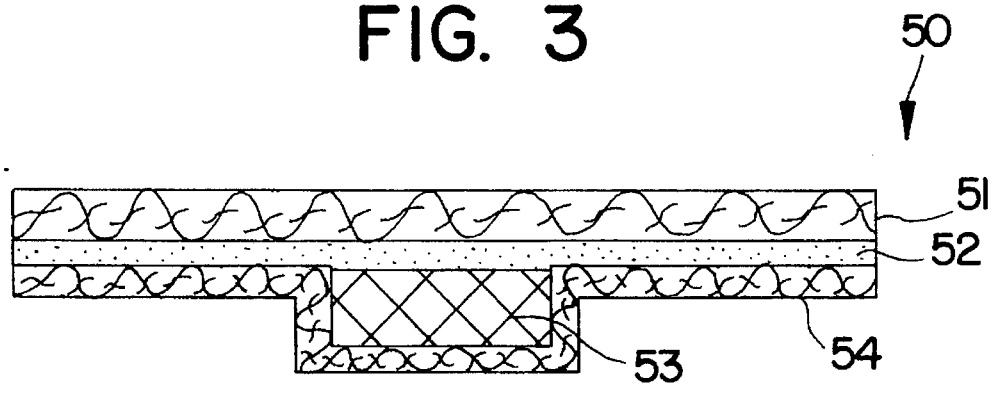
FIG. 4 is a sectional view of the closure system of the present invention taken along either of the lines 4—4 in FIG. 3, showing only one magnet for purposes of illustration.

A magnet assembly 50 is prepared for the closure system, as shown in FIG. 4. The magnet assembly 50 is a laminate produced from a support layer 51 to which is added an adhesive layer 52. A series of one or more magnets 53 are positioned on the adhesive layer 52 to align and retain them in place. Finally, a cover layer 54 is added over the one or more magnets 53, and the cover layer 54 shapes to the one or more magnets 53 to form the laminate that is the magnet assembly 50.

Initially, a support layer 51 is provided. Generally, the support layer 51 can be selected from fabrics, woven or otherwise, that resist linear stretch and compression. The physical properties of the support layer 51 are important to provide accurate spacing for the magnets, as well as precise and lasting alignment for them, to prevent bunching of the magnets. The fabric is preferably thin so as to maintain good contact with the magnets but has sufficient texture to add a desirable amount of body to the seam 15. A suitable support layer useful in the closure system for the present invention is woven Dacron fabric, Dacron being a trademark of E. I. Du Pont de Nemours & Co., Wilmington, Del. 19898 for a polyester fiber made from polyethylene terephthalate. Also useful is a loosely woven fabric known as SIRI, sold by Symphony Fabrics, 329 W 36th Street, New York, N.Y. 10018. A preferred fabric for use in the present invention is a cotton fabric.

The magnets 53 are attached to the support layer 51. While various means to attach the magnets are known in the art and can be used in the present invention, an adhesive layer 52 has been found particularly useful. Compared to more conventional means of attachment, such as stitching, an adhesive layer 52 provides the maximum surface contact between the components of the laminate of the magnet assembly 50. Additionally, an adhesive layer 52 provides some measure of protection from corrosion to the magnet through the life of the garment.

In a preferred embodiment, the adhesive layer 52 is a nonridged hot melt adhesive matrix. Angel Hair, available from Handler Textiles, New York, N.Y. is the name used to describe matted filaments of hot glue under the label "Stitch Witchery" or "Magic Fuse" and is a suitable adhesive for use.

Alternatively, a liquid adhesive may be useful, especially for clothing for extreme weather conditions or industrial applications. A liquid adhesive provides greater flexibility where extremes of cold or heat would render the closure system inflexible or cause it to self-destruct due to heat stress.

Also for use in industrial and even marine applications, a heat fusible non permeable membrane is an additional embodiment of the adhesive layer 52 for the closure system 20 of the present invention. Such a membrane may also create a water-proof environment to protect the magnet from corrosion due to moisture or from a corrosive atmosphere. Selection of an adhesive for use in the present invention will be obvious to one skilled in the relevant art, as determined by the type of garment in which the magnet assembly 50 is used and the garment's application.

At least one magnet 53 is attached to the support layer 51 in the closure system 20 of the present invention. Magnets 53 chosen for use in the closure system 20 of the present invention must have sufficient magnetic strength to securely close a garment, that is, to bring the opposing closure surfaces together and to maintain closure despite pressure placed on the garment 10, the seam 15 and the closure system 20 due to movement by the wearer of the garment. The magnets 53 have to stay joined even through a full range of movement and force applied on the garment by that movement. Conversely, the magnets 53 must give when the wearer wishes to open the seam 15 by peelably disengaging the one magnet assembly 50 from its cooperating magnet assembly 50, for removal of the garment or adjustment.

Selection of the magnet 53 for use in the closure system of the present invention must also be mindful that the weight of the garment as a whole must be light, and balanced so that the side of the garment in which the closure system 20 is placed does not weigh considerably more and hang unbalanced on the garment wearer. It is also important that the magnet 53 be relatively hidden to the casual observer. Consequently, the selection must focus on the size of the magnet, the number of magnets used and the weight of the individual magnet, as well as the material from which it is made.

While any material for a magnet may be used in the present invention, it has been found that rare earth cobalt alloys are particularly useful for the present invention. These alloys are usually binary or tertiary alloys with the approximate atomic ratio of one rare earth atom to five cobalt atoms. Suitable rare earth elements are samarium, praseodymium, cerium, neodymium or mixtures of those. Especially preferred is neodymium.

Such magnets 53 useful in the present invention are approximately 0.250 inches to 0.750 inches diameter in size and approximately 0.030 to 0.090 inches thick. Preferably, the magnet chosen for use with the closure system 20 of the present invention is Neodymium 0.27 available from Rochester Magnet, 2011 East Main Street, Rochester, N.Y. 14609, a magnet approximately 0.50 inches diameter and 0.06 inches thick.

It has been found that for best results, each individual magnet 53 will be magnified to the maximum extent possible in light of its size and the element from which it is made. Care must be taken to magnetize to its technical saturation to maximize the life of the closure system 20 and to ensure proper closure.

It has also been found that a coating of zinc can provide protection to the magnet through the life of the garment in which the closure system 20 is placed. In an additional embodiment, zinc may be applied in a layer to the magnet to prevent corrosion, especially in applications in which the magnets will get wet or exist in a corrosive atmosphere.

Magnets useful in the present invention have a specific polarization or the magnets must be polarized for purposes of joining the closure system of the present invention. A positively polarized magnet from the one magnet assembly must meet a negatively polarized magnet from a cooperating magnet assembly for joining to take place. In a preferred embodiment, a positively polarized magnet from the one magnet assembly must meet a negatively polarized magnet of substantially equal magnetic field strength from a cooperating magnet assembly for joining to take place. Of course, if a positively polarized magnet from one magnet assembly meets a positively polarized magnet from the other magnet assembly, the magnets will repel each other and the seam will not close. Similarly, if a positively polarized magnet from a magnet assembly meets a negatively polarized magnet from the cooperating magnet assembly that has significantly greater or lesser magnetic field strength, the magnets will not join or they may join but not remain joined for the length of time desired by the garment wearer. Substantially equal magnetic field strength shall mean magnetic field strength values in the same approximate range so that the oppositely charged magnets will attract each other, join and stay joined until peelably removed by the garment wearer.

If there is more than one magnet on a magnet assembly, the magnets of that one magnet assembly are preferably positioned on that magnet assembly in excess of the weight attraction intermagnetic distance from all the other magnets on that magnet assembly. By "weight attraction intermagnetic distance" is meant the distance at which a magnet of a particular weight, magnetic field strength and polarity will attract another magnet of approximately equal weight, magnetic field strength and opposite polarity. That is, each magnet in one magnet assembly is preferably separated by a distance determined by the attractive force of the magnets. The magnets should be separated by a distance at which the attractive force of the magnets is generally less than about 50% of the weight of the magnet at that distance. By way of clarification, for a magnet weighing 5 grams, the next lateral magnet on a magnet assembly is not closer than that point at which the magnetic attraction would be about 2.5 grams. In another embodiment, the weight attraction intermagnetic distance between magnets in a magnet assembly is that point at which the attraction does not exceed about 25% of the weight of the magnet. Finally, in another embodiment, the distance between magnets in one magnet assembly is that point at which the attraction will not exceed about 10% of the weight of the magnet.

If oppositely charged magnets 53 in the same magnet assembly 50 are sufficiently close, the magnets may fall within the weight attraction intermagnetic distance and the magnets may have an increasingly likelihood of being pulled to each other and the magnet assembly 50 will bunch up. Clearly, garment flexibility, weight and flexure will impact on any actual bunching. In one embodiment of the present invention using Neodymium .27 magnets, it has been determined that magnets 53 in a magnet assembly 50 are preferably positioned no closer than approximately 2–4 inches to reduce bunching. Additionally, magnets placed too far apart can provide reduced closure, with seams gaping. Consequently, the magnets 53 in a magnet assembly 50 are placed approximately 3 inches apart for best operation using the preferred magnets. Additionally, each magnet assembly has a number of magnets 53 contained therein as determined by the length of the seam to be closed on the garment. The figures illustrate a magnet assembly 50 containing three magnets, but it is obvious that more or less can be used to produce a closure system according to the present invention depending on the application.

Finally, a cover layer 54 is positioned adjacent the exposed side of the magnet in a magnet assembly and is attached to the magnet. The cover layer 54 preferably will be flexible to conform to the shape of the magnet on which it is placed. While flexible layers of many substances can be used in the present invention, particularly suitable are bias woven or stretch knit fabrics, such as Denier Knit available from Symphony Fabrics Corp., 329 W. 36th Street, New York, N.Y. 10018, under the name "Quicksilver". A particularly useful fabric for the cover layer 54 in the present invention is a polyester fabric having a polyurethane film adhesive layer, sold under the trademark EMBOSS, by Freudenberg Nonwovens, 20 Industrial Avenue, Chelmsford, Mass. 01824. If this fabric is used as the cover layer, of course, no additional adhesive layer 52 will be necessary. The flexibility of the layer 54 assures full contact of the layer 54 to the magnet 53 during bonding by conforming to surface irregularities. Additionally, the inclusion of this layer 54 increases the flexibility of the finished closure system 20, allowing the system 20 to be used on dynamic applications such as clothing.

A magnet assembly is positioned on a closure surface 21 of a garment 10 and a cooperating magnet assembly 50 is positioned on the opposing closure surface 23 of the garment 10. Each magnet assembly is interdimensionally fixed to its respective closure surface 21, 23, with the cover layer 54 adjacent the respective closure surface 21, 23, such as by sewing thereto. Magnet assemblies are interdimensionally fixed when a magnet from one magnet assembly is positioned so as to cooperate with a specific magnet 53 from the cooperating magnet assembly when the garment is closed in a manner in which it was designed to be closed, and each magnet 53 in each magnet assembly 50 is joined to a cooperating magnet 53 from the cooperating magnet assembly 50. By way of clarification, the closure system 20 of the blouse of FIG. 1 has three sets of cooperating magnets interdimensionally fixed such that the top magnet of the magnet assembly on first opposing closure surface 21 addresses and joins with the top magnet on the cooperating magnet assembly on second opposing closure surface 23 while permitting the remaining two magnets in each assembly to address and join the similarly placed magnet in the other magnet assembly so that the garment closes.

Joining of the closure system occurs when the support layers 51 from two cooperating magnet assemblies 50 are placed near each other and the magnets attract. Placing the support layers 51 near each other, as opposed to the cover layers 54 maintains a strong closing face and increases contact area of the magnets to prevent gaping of the seam to be fastened. The closure system is substantially self operating—in effect, if the magnets are properly positioned and aligned as described above, the magnets "find" each other and the system closes with limited assistance from the garment wearer.

The closure system of the present invention has been shown in connection with a blouse and in particular positioned in a side seam of a blouse, under the arm. It can be seen easily that the system has usefulness in a variety of clothing garments or with two garments to be joined, as described above. There are no limits on the placement of the closure system on the garment beyond the ease of the wearer. Accordingly, the closure system of the present invention can be placed on the waist band of a pair of pants or slacks, on the shoulder of a blouse, on the front panel of a coat or wherever it is convenient and practical to place the system for the ease of the wearer.

While the invention has been illustrated and described as embodied in a closure system for a shirt, it is not intended to be limited to the details shown, since various modifications and structural changes can be made without departing in any way from the spirit of the present invention.

What is claimed is:

1. A closure system for a garment comprising cooperating magnet assemblies interdimensionally fixed on opposing closure surfaces of the garment and magnetically opposable to each other, said cooperating magnet assemblies serving to securely and removably join said opposing closure surfaces, wherein said cooperating magnet assemblies each comprise:

a support layer;

an adhesive layer bonded to the support layer;.

at least one securing body bonded to the adhesive layer;

a cover layer positioned adjacent said at least one securing body and bonded to said at least one securing body and to said adhesive layer.

2. The closure system of claim 1 wherein the at least one sectoring body comprises at least one magnet in one of the cooperating magnet assemblies and at least one metal disc on the other of the cooperating magnet assemblies.

3. The closure system of claim 1 wherein the at least one securing body in each of the cooperating magnet assemblies comprises at least one magnet, and the at least one magnet in one of the cooperating magnet assemblies is of approximately equal magnetic field strength and opposite polarity to the at least one magnet in the other cooperating magnet assembly.

4. The closure system of claim 3 wherein the at least one magnet in each of the cooperating magnet assemblies comprise neodymium magnets of about 0.250 to about 0.750 inches in diameter, and being about 0.030 to about 0.090 inches thick.

5. The closure system of claim 3 wherein in each magnet assembly, the at least one magnet comprises more than one magnet and within each magnet assembly each of the more than one magnet is positioned in excess of the weight attraction intermagnetic distance from another of the more than one magnet.

6. The closure system of claim 5 wherein in each magnet assembly, the more than one magnet is positioned about 2 to 4 inches from adjacent magnets in the same magnet assembly, said more than one magnet in each of the magnet assemblies positioned in the respective magnet assembly so that when the opposing closure surfaces are positioned near each other, each of the more than one magnet in one magnet assembly will attract a magnetically opposable magnet in the other magnet assembly to fasten the garment.

7. A garment including two opposing closure surfaces comprising a closure system having a magnet assembly on each of the two opposing closure surfaces, said magnet assemblies being cooperating and magnetically opposable and serving to securely and removably join said opposing closure surfaces, wherein said cooperating magnet assemblies each comprise:

a support layer;

an adhesive layer bonded to the support layer;

at least one securing body bonded to the adhesive layer;

a cover layer positioned adjacent said at least one securing body and bonded to said adhesive layer and to said at least one securing body.

8. The garment of claim 7 wherein the at least one securing body in the closure system comprises at least one magnet in one of the cooperating magnet assemblies and at least one metal disc on the other of the cooperating magnet assemblies.

9. The garment of claim 7 wherein the at least one securing body in each of the cooperating magnet assemblies comprises at least one magnet, and the at least one magnet in one of the cooperating magnet assemblies is of approximately equal magnetic field strength and opposite polarity to the at least one magnet in the other cooperating magnet assembly.

10. The garment of claim 9 wherein the at least one magnet in each magnet assembly comprise neodymium magnets, about 0.250 to about 0.750 inches in diameter, and being approximately 0.030 to approximately 0.090 inches thick.

11. The garment of claim 9 wherein the at least one magnet in the cooperating magnet assemblies comprises more than one magnet and each of the more than one magnet is positioned in excess of the weight attraction intermagnetic distance from another of the more than one magnet in the respective magnet assembly.

12. The garment-of claim 11 wherein each of the more than one magnet is positioned approximately 2 to 4 inches from any other of the more than one magnet in the respective magnet assembly.

13. A system to join two objects comprising a first magnet assembly fixed on one object and a second magnet assembly fixed on the other object, said first magnet assembly cooperating with said second magnetic assembly to securely and removably join said two objects, wherein said cooperating magnet assemblies are magnetically opposable and each comprises:

a support layer;

an adhesive layer bonded to the support layer;

at least one securing body bonded to the adhesive layer;

a cover layer positioned adjacent said at least one securing body and bonded to said adhesive layer and said at least one securing body.

14. The system of claim 13 wherein the at least one securing body comprises at least one magnet in one of the cooperating magnet assemblies and at least one metal disc in the other of the cooperating magnet assemblies.

15. The system of claim 13 wherein the at least one securing body in each of the cooperating magnet assemblies comprises at least one magnet, and the at least one magnet in one of the cooperating magnet assemblies is of approximately equal magnetic field strength and opposite polarity to the at least one magnet in the other cooperating magnet assembly.

16. The closure system of claim 15 wherein the at least one magnet in each of the cooperating magnet assemblies comprise neodymium magnets of about 0.250 to about 0.750 inches in diameter, and being about 0.030 to about 0.090 inches thick.

17. The closure system of claim 15 wherein in each magnet assembly, the at least one magnet comprises more than one magnet and within a magnet assembly each magnet is positioned in excess of the weight attraction intermagnetic distance from another.

18. The system of claim 17 wherein each magnet in one magnet assembly is positioned about 2 to 4 inches from adjacent magnets in the same magnet assembly than one magnet in each of the magnet assemblies positioned in the respective magnet assembly so that when the objects are positioned near each other, each of the more than one magnet in the first magnet assembly will attract magnetically opposable magnet in the second magnet assembly to join the objects.

* * * * *

UNITED STATES PATENT AND TRADEMARK OFFICE

CERTIFICATE OF CORRECTION

PATENT NO. : 5,604,960

DATED : February 25, 1997

INVENTOR(S) : Good, Elaine M.

It is certified that error appears in the above-indentified patent and that said Letters Patent is hereby corrected as shown below:

Column 6, Line 54: Delete ".27" and insert -- .27 -- therefor;

Column 8, Line 18: Delete "sectoring" and insert -- securing -- therefor;

Column 10, Line 13: Delete "closure";

Column 10, Line 18: Delete "closure";

Column 10, Line 25: After "assembly" insert -- , said more --;

Column 10, Line 30: After "attract" insert -- a --.

Signed and Sealed this

Tenth Day of June, 1997

Bruce Lehman

*Attest:*

BRUCE LEHMAN

*Attesting Officer*

*Commissioner of Patents and Trademarks*